US008704727B2

(12) United States Patent
Cruz et al.

(10) Patent No.: US 8,704,727 B2
(45) Date of Patent: Apr. 22, 2014

(54) COMPACT MULTIBEAM ANTENNA

(75) Inventors: Eduardo Motta Cruz, Saint Herblain (FR); Xavier Sammut, Marly-le-Roy (FR); Maxime Tiague Leuyou, Rueil-Malmaison (FR); Vincent Rabussier, Lyons (FR)

(73) Assignee: Bouygues Telecom, Paris (FR)

( * ) Notice: Subject to any disclaimer, the term of this patent is extended or adjusted under 35 U.S.C. 154(b) by 198 days.

(21) Appl. No.: 13/319,992

(22) PCT Filed: May 11, 2010

(86) PCT No.: PCT/EP2010/056416

§ 371 (c)(1),
(2), (4) Date: Jan. 25, 2012

(87) PCT Pub. No.: WO2010/130714

PCT Pub. Date: Nov. 18, 2010

(65) Prior Publication Data

US 2012/0133559 A1 May 31, 2012

(30) Foreign Application Priority Data

May 11, 2009 (FR) ..... 09 53086

(51) Int. Cl.
*H01Q 21/00* (2006.01)
*H01Q 1/38* (2006.01)

(52) U.S. Cl.
USPC ..... 343/853; 343/700 MS; 343/810

(58) Field of Classification Search
None
See application file for complete search history.

(56) References Cited

U.S. PATENT DOCUMENTS

| | | | | |
|---|---|---|---|---|
| 6,611,239 | B2 * | 8/2003 | Hook | 343/893 |
| 8,497,814 | B2 * | 7/2013 | Puente et al. | 343/893 |
| 2009/0021437 | A1 | 1/2009 | Foo | |
| 2010/0277374 | A1 * | 11/2010 | Ju et al. | 343/700 MS |
| 2013/0176188 | A1 * | 7/2013 | Motta Cruz | 343/844 |

FOREIGN PATENT DOCUMENTS

| | | |
|---|---|---|
| DE | 101 10 256 | 9/2002 |
| FR | 2 945 380 | 11/2010 |
| WO | WO 98/27614 | 6/1998 |
| WO | WO 99/17403 | 4/1999 |
| WO | WO 01/06595 | 1/2001 |
| WO | WO 03/009752 | 2/2003 |
| WO | WO 2007/126831 | 11/2007 |
| WO | WO 2007/146685 | 12/2007 |
| WO | WO 2008/126985 | 10/2008 |

* cited by examiner

*Primary Examiner* — Trinh Dinh
(74) *Attorney, Agent, or Firm* — Blakely Sokoloff Taylor & Zafman

(57) ABSTRACT

The invention relates to a multibeam antenna for emitting/receiving a radiofrequency signal in a plurality of directions in at least one frequency band, the antenna including: a floorplan (P); a dielectric substrate (11) having a permittivity ($\in_1$), the substrate (11) being arranged on the floorplan (P); and a plurality of assemblies ($E_i$) of antenna elements arranged on the substrate (11), each assembly ($E_i$) corresponding to a direction of the antenna. The antenna according to the invention is characterized in that said antenna also includes a dielectric superstate (12), having a higher permittivity ($\in_2$) than the permittivity ($\in_1$) of the substrate (11), arranged on the assemblies ($E_i$) of antenna elements, and in that the assemblies ($E_i$) are interleaved one under the other so as to form a column, the assemblies ($E_i$) corresponding to a single antenna direction being separated by a number of assemblies equal to the number of antenna directions.

10 Claims, 5 Drawing Sheets

Operation in λ/2 dipole mode

Distribution of the electric fields

Operation in λ/4 dipole mode

COMPACT MULTIBEAM ANTENNA

CROSS-REFERENCE TO RELATED APPLICATIONS

The present application is a non-provisional application claiming the benefit of International Application Number PCT/EP2010/056416, filed May 11, 2010, which claims priority under 35 USC 119 to French Patent Application Number 0953086, filed May 11, 2009, which are incorporated herein by reference in their entirety.

GENERAL TECHNICAL FIELD

The invention relates to the field of monofrequency of multifrequency multibeam antenna for emitting/receiving a radiofrequency signal in a plurality of directions.

STATE OF THE PRIOR ART

Obtaining one or more beams from directive antenna takes place to the detriment of the size of the antenna.

Indeed, the more the antenna has to be directive (in other words the more it is wished to have an antenna that can radiate in one favoured direction or several directions and has to have several independent beams) the greater must be its radiating surface area.

FIG. 1 illustrates a multibeam antenna of known type.

This antenna, constituted of three panels $P_1$, $P_2$, $P_3$, can operate in three directive beams.

This antenna—see FIG. 2—comprises a ground plane P and a dielectric substrate 11, having a dielectric constant $\in_1$. The substrate 11 is arranged on the ground plane P.

The antenna further comprises a plurality of assemblies $E_i$ of antenna elements, said antenna elements $S_{ij}$ are arranged on the substrate 11 (i corresponds to the number of the assembly and j to the number of the antenna element in the assembly i).

The antenna elements $S_{ij}$ are suited to emitting/receiving a radiofrequency signal in a given direction so that each assembly $E_i$ is associated with a direction of the antenna. It is considered that the antenna emits/receives the signal in one or more frequency bands in different directions, defined by each panel.

FIG. 2 illustrates in a schematic manner an assembly $E_1$ of antenna elements $S_{ij}$.

The elements $S_{ij}$ are supplied according to a distribution law ($a_{ij}$, $\phi_{ij}$), $a_{ij}$ being the amplitude of the emitted or received signal and $\phi_{ij}$ its phase. This law is applied to each group of assemblies i (formed of antenna elements j) of the same panel with the aim of forming a coherent radiation pattern and favouring a determined direction $A_1$, $A_2$, $A_3$, normally a given azimuth in the horizontal plane. In its most simple form, the elements $E_i$ are supplied in series or in arborescence.

FIGS. 3*a* and 3*b* illustrate respectively a top view and a side view of the ground plane P with the substrate 11 and an antenna element $S_{i1}$ used in antennas of known type.

In multibeam antennas of this type (see FIG. 1), the assemblies corresponding to a single direction are arranged in several columns, typically up to four columns. The columns are moreover arranged side by side.

A problem is that such an arrangement is bulky, particularly with a view to having more and more directive antennas, in other words that can radiate in several directions. Indeed, it would be necessary to add columns.

DESCRIPTION OF THE INVENTION

The invention makes it possible to have a multibeam antenna of reduced size compared to known antenna solutions of the same type.

According to a first aspect, the invention relates to a multibeam antenna for emitting/receiving a radiofrequency signal in a plurality of directions in at least one frequency band, the antenna comprising: a ground plane; a dielectirc substrate, having a permittivity, the substrate being arranged on the ground plane; a plurality of assemblies of antenna elements arranged on the substrate, each assembly corresponding to a direction of the antenna.

The antenna according to the invention is characterised in that it further comprises a dielectric superstrate, having a permittivity greater than the permittivity of the substrate, arranged on the assemblies of antenna elements, and in that the assemblies are interleaved one under the other so as to form a column, the assemblies corresponding to a single antenna direction being separated by a number of assemblies equal to the number of antenna directions.

The antenna according to the invention may moreover exhibit one or more of the following characteristics:

- the antenna elements of a single assembly are spaced apart by a distance less than a wavelength λ, the wavelength λ corresponding in the monofrequency case to the frequency at which the antenna has to operate and in the multifrequencies case to the central frequency defined by $(f_{max}-f_{min})/2$ where $f_{max}$ is the maximum frequency at which the antenna has to operate and $f_{min}$ is the minimum frequency at which the antenna has to operate;
- the antenna elements belonging to different assemblies are spaced apart by a distance less then λ/n, where X correspond to: in the monofrequency case, to the frequency at which the antenna has to operate; in the multifrequencies case, to the central frequency defined by $(f_{max}-f_{min})/2$ where $f_{max}$ is the maximum frequency at which the antenna has to operate and $f_{min}$ is the minimum frequency at which the antenna has to operate; and where n is the number of different assemblies ($E_i$);
- for each direction of the antenna an identical number of assemblies of antenna elements;
- the assemblies corresponding to a single antenna direction are connected in series or in arborescence;
- each assembly comprises an identical number of antenna elements;
- the antenna elements are square, equilateral triangle shaped or ellipsoidal shaped patches;
- each side of each element is of dimension equal to $$a\frac{\lambda_0}{4\sqrt{\varepsilon_1+\delta\varepsilon_2}}$$

where $\in_1$ is the permittivity of the substrate and $\in_2$ is the permittivity of the superstrate, $\lambda_0$ is the wavelength corresponding to the frequency associated with the antenna element, the value σ is approximately equal to: $\sigma=h_1/(_{h1+d})$;

- the antenna elements are orthogonal double polarisation patches having two independent accesses making it possible to achieve diversity of polarisation.

The antenna according to the invention is monofrequency or multifrequency and in each frequency band it is possible to have several beam directions.

According to a second aspect, the invention relates to a cellular communication network comprising an antenna according to the first aspect of the invention.

DESCRIPTION OF DRAWINGS

Other characteristics and advantages of the invention will become clearer on reading the description that follows, which is purely illustrative and non limiting and should be read with reference to the appended drawings in which, apart from FIGS. 1, 2, 3*a* and 3*b* already discussed.

DETAILED DESCRIPTION OF THE INVENTION

Structure of the Antenna

Figure 2:
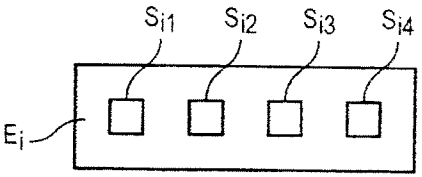
Figure 3A:
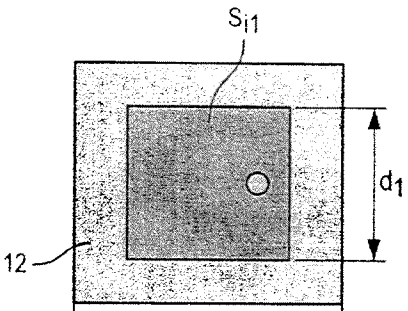
Figure 3B:
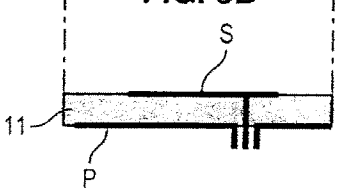
Figure 1:
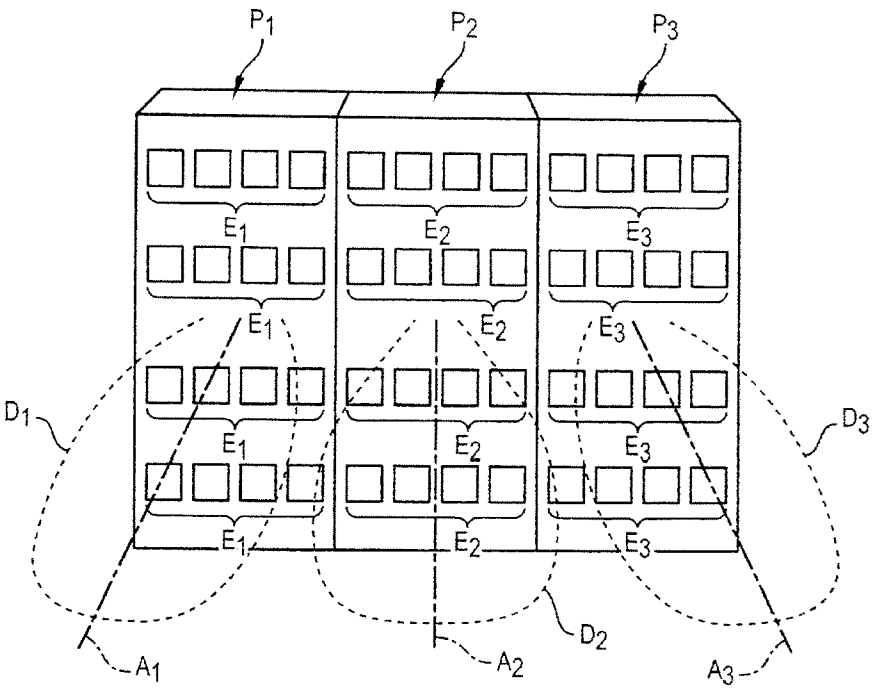
Figure 4:
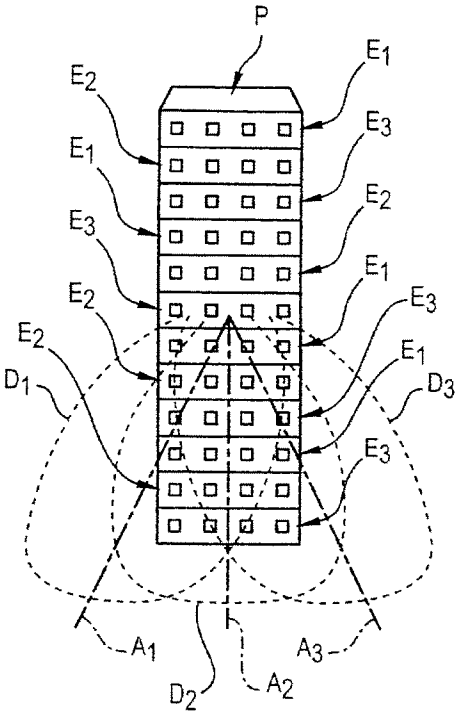
FIG. 4 illustrates a multibeam antenna according to the invention.

FIG. 4 illustrates a multibeam antenna having a reduced size compared to multibeam antenna of known type (see antenna of FIG. 1).

Figure 5A:
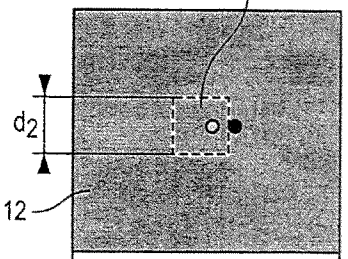
FIGS. 5*a* and 5*b* illustrate respectively a top view and a side view of the ground plane with a dielectric substrate and superstrate and an antenna element of the antenna of the invention.
Figure 5B:
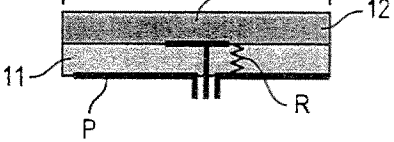

FIGS. 5*a* and 5*b* illustrate, respectively, a top view and side view of the ground plane P with the substrate 11, the superstrate 12 and an antenna element $S_{i1}$.

This antenna comprises a ground plane P, a dielectric substrate 11 having a dielectric constant $\in 1$ arranged on the ground plane P and a plurality of assemblies $E_i$ of antenna elements $S_{ij}$ arranged on the substrate 11.

As already mentioned, each assembly $E_i$ corresponds to a direction of the antenna.

To reduce the size of the antenna, the assemblies $E_i$ of antenna elements $S_{ij}$ are interleaved one under the other so as to form a column and the assemblies $E_i$ which correspond to a single antenna direction are separated by a number of assemblies equal to the number of directions of the antenna.

In other words, a single direction of antenna is found on the column of assemblies of antenna elements in a periodic manner, the period being equal to the number of direction of the antenna.

Such an interleaving can generate a coupling between the antenna elements which are closer than in antennas of known type.

To avoid the coupling between the antenna elements, the size of the antenna elements is reduced.

This reduction in size is possible by the fact that the antenna comprises a dielectric superstrate 12 having a permittivity $\in_2$ greater than the permittivity $\in_1$ of the dielectric substrate 11.

The use of this superstrate 12 makes it possible to conserve radiation characteristics identical to an antenna element of larger size.

Figure 11A:
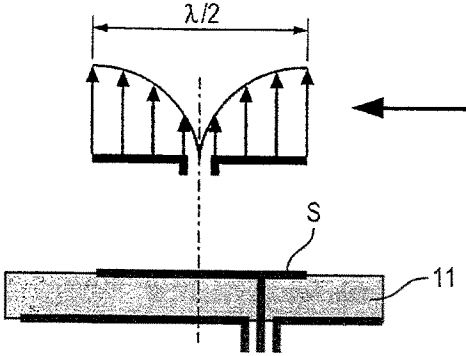
FIGS. 11*a* and 11*b* illustrate the reduction in size from a dipole into a monopole used in the antenna of the invention.
Figure 11B:
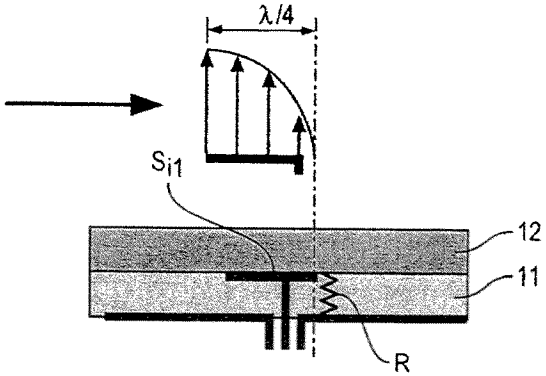

Moreover, a resistance R is connected between the ground plane P and each antenna element $S_{ij}$. The resistance R is typically equal to one Ohm. This resistance R serves to short-circuit one of the radiating sides of the antenna element. This short-circuit serves to transform the radiating element of size $\lambda/2$, constituted of two monopoles, each of size $\lambda/4$ of each side of the dipole, into a single monopole of size $\lambda/4$ and consequently makes it possible to divide by two the electrical dimensions of the radiating element (see FIG. 11).

Said resistance R also makes it possible to increase substantially the pass band of the antenna in its resonating behaviour.

In order to obtain good performances for each direction of the antenna, the assemblies $E_i$ which correspond to a single direction of antenna are connected together in series.

The antenna elements belonging to different assemblies are spaced apart by a distance less than $\lambda/n$, where $\lambda$ corresponds:

- in the monofrequency case, to the frequency at which the antenna has to operate;
- in the multifrequencies case, to the central frequency defined by $(f_{max}-f_{min})/2$ where $f_{max}$ is the maximum frequency at which the antenna has to operate and $f_{min}$ is the minimum frequency at which the antenna has to operate; and where
- n is the number of different assemblies ($E_i$).

Typically a spacing less than $0.9\lambda/n$ will be taken.

The antenna elements of a single assembly are for their part spaced apart by a distance less than $\lambda$.

The spacing constraints make it possible to obtain a radiation pattern of the different elements with a single main lobe in an angular aperture (−90°, +90°) of the plane of the assembly with respect to the main radiation axis perpendicular to the assembly.

Beyond this spacing, additional main lobes appear at each end of the angular aperture (−90°, +90°) degrading the directivity performances of the assembly.

Monofrequency Case

Figure 7:
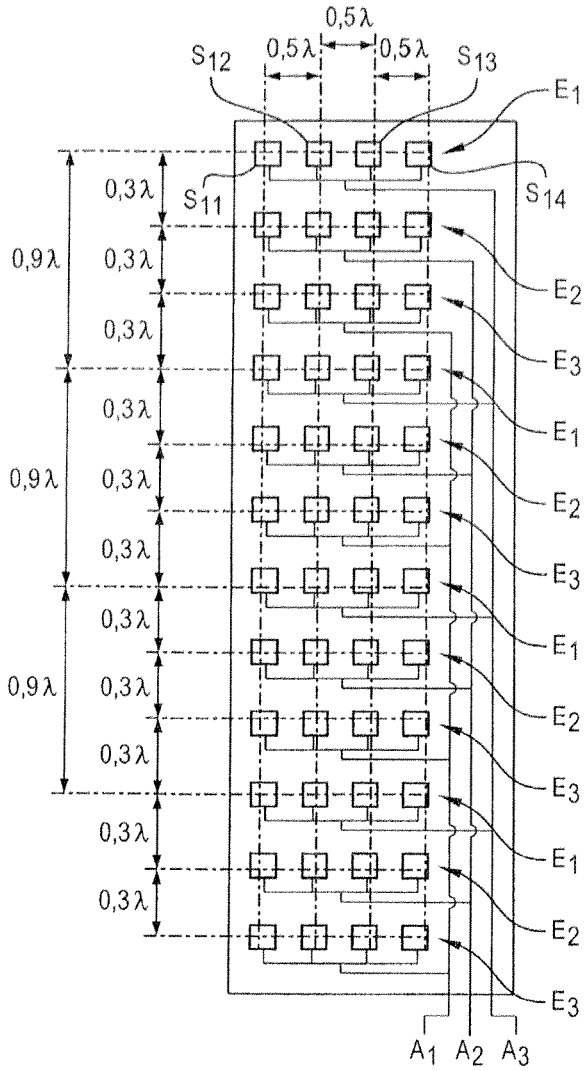
FIG. 7 illustrates an antenna with three monofrequency beams according to the invention.

In FIG. 7 is illustrated an antenna with three monofrequency beams A, B, C. In this figure, in each assembly $E_1$, $E_2$, $E_3$ the antenna elements $S_{ij}$ are connected together.

Furthermore, all of the assemblies $E_1$ are connected to obtain a first beam A, all of the assemblies $E_2$ are connected to obtain a second beam B and all of the assemblies $E_3$ are connected to obtain a third beam C.

The antenna elements of a single assembly are separated by a distance of $0.5\lambda$ and the antenna elements of different assemblies are separated by a distance of $0.3\lambda$ (there are three different beams).

Compared to antennas of known type using a single beam, the use of several beams (particularly the use of a single UMTS carrier with a different scrambling code per beam) makes use of independent and physically similar antennas having radiation patterns with different azimuths in the horizontal plane.

This approach entails an increase in the overall surface of the antenna solution, comprising a plurality of specific antennas.

Multifrequencies Case

Figure 8:
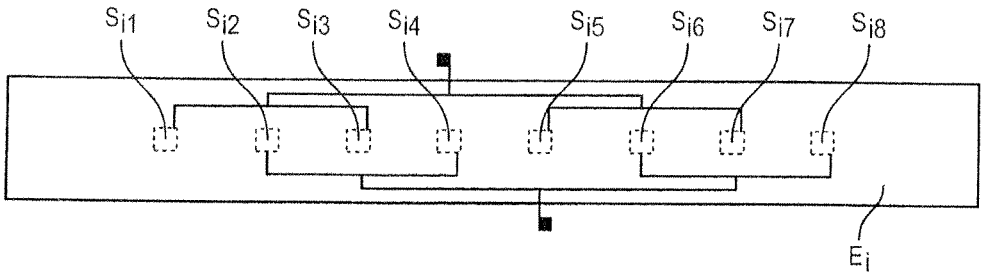
FIG. 8 illustrates an arrangement of antenna elements in an assembly for a bifrequency antenna according to the invention.

In FIG. 8 is illustrated the arrangement of antenna elements $S_{ij}$ in an assembly $E_i$ for a bifrequency antenna. The number of antenna elements $S_{ij}$ is doubled compared to a monofrequency antenna (see FIG. 7).

Compared to antennas of known type, the use of several close frequencies for different telecommunications standards (particularly the use of the spectrum 880-960 MHz for GSM and UMTS) makes use of independent and physically similar antennas having the same radiation pattern.

This approach entails an increase in the overall surface of the antenna solution, comprising a plurality of specific antennas.

Antenna Elements $S_{ij}$

The antenna elements $S_{ij}$ are preferably square or equilateral triangle shaped patches of sides of dimension d:

$$d = \frac{\lambda_0}{4\sqrt{\varepsilon_1 + \delta\varepsilon_2}}$$

where $\in_1$ is the dielectric constant of the substrate and $\in_2$ is the dielectric constant of the superstrate, $\lambda_0$ is the wavelength in a vacuum, $\sigma$ is the partial contribution of the dielectric $\in_2$ in the radiation of the cavity of the radiating element.

Figure 12:
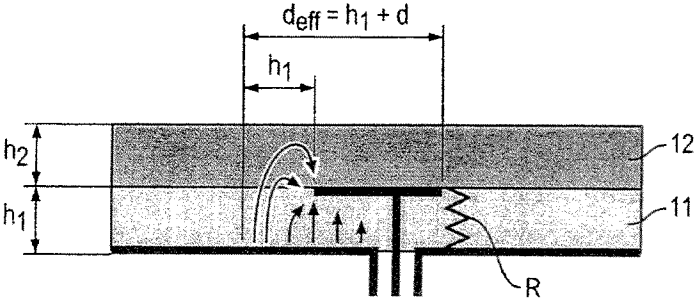
FIG. 12 illustrates a side view of the ground plane with a dielectric substrate and superstrate and an antenna element of the antenna of the invention to explain the dimensions of the antenna element.

This radiation operates in effective dimensions taking into account the physical dimension d of the element and an overflow of the fields, which extend over a distance approximately the value of the thickness $h_1$ of the substrate (see FIG. 12). It may be noted that the value $\sigma$ is approximately equal to:

$$\delta = \frac{h_1}{h_1 + d}.$$

Figure 6A:
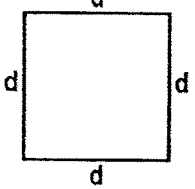
FIGS. 6*a* and 6*b* illustrate respectively a square patch and an equilateral triangle shaped patch implemented in the antenna of the invention.
Figure 6B:
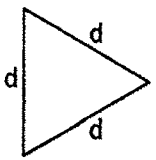

FIGS. 6*a* and 6*b* illustrate respectively a square patch and an equilateral triangle shaped patch, each side is of dimension d (see above).

Thanks to the reduction in the dimensions of the antenna elements $S_{ij}$, the interleaving of the assemblies $E_i$ is possible and the size obtained is identical to the size necessary for a single direction of the antenna of known type (see the comparison between the configuration of FIG. 1 and the configuration of FIG. 4).

Performances

Figure 9:
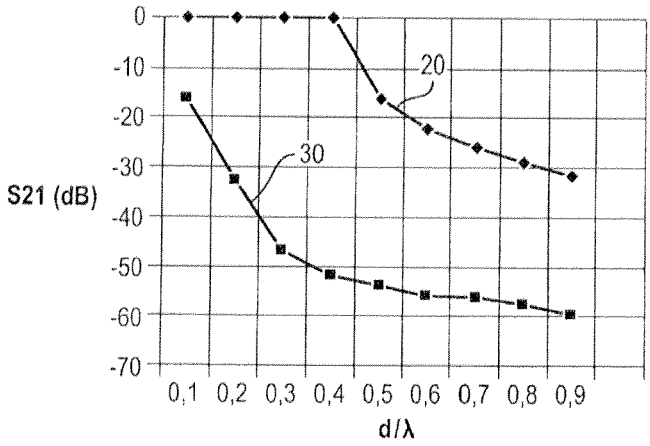
FIG. 9 illustrates the variation of the coupling between two assemblies of antenna elements as a function of the distance between the elements for the elements of an antenna of known type and for smaller elements, implemented in an antenna of the invention, having identical radiation characteristics.

FIG. 9 illustrates the coupling between two assemblies of antenna elements as a function of the distance between the elements for the elements of the antenna of known type (curve 20) and for the smaller elements (curve 30) having identical radiation characteristics. To ensure good operation between different systems, it is aimed to obtain a coupling between different antennas less than −30 dB.

With a typical distance of 0.4λ between the antenna elements, the two antennas of known type have a coupling between each other of around −10 dB whereas with the same spacing, the two antennas with the smaller antenna elements have a coupling less than −50 dB between them.

Figure 10:
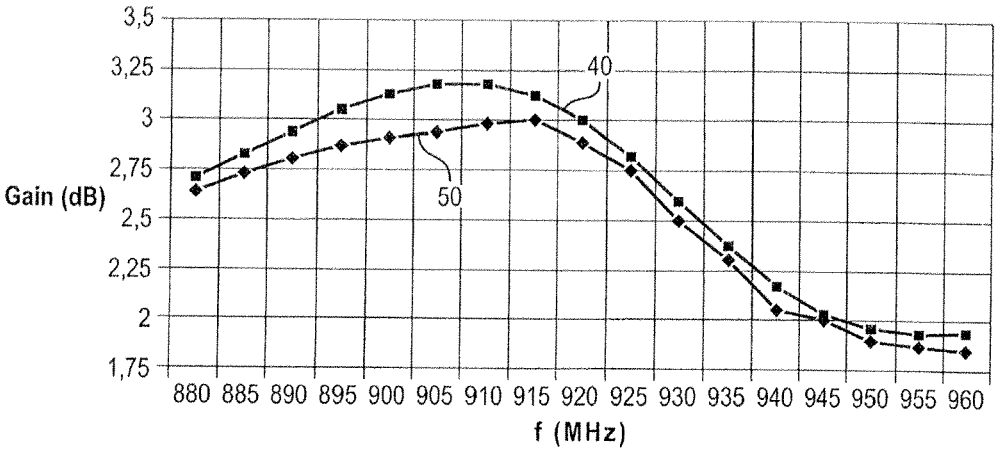
FIG. 10 illustrates the performances in terms of isotropic gain of the antenna elements of an antenna of known type and for an antenna with smaller elements implemented in an antenna of the invention, having identical radiation characteristics.

FIG. 10 illustrates the performances in terms of isotropic gain of the antenna elements of the antenna of known type (curve 40) and for the antenna with smaller elements (curve 50).

It is observed that, despite the addition of the superstrate and the substantial reduction in the physical dimensions of the compact radiating element, its gain is around 3 dBi at the resonance frequency, scarcely 0.2 dB below the gain of a conventional radiating element (around 3.2 dBi).

The invention claimed is:

1. Multibeam antenna for emitting/receiving a radiofrequency signal in a plurality of directions in at least one band of frequencies, the antenna comprising:

a ground plane (P);

a dielectric substrate (11), having a permittivity $\in_1$, the substrate (11) being arranged on the ground plane (P);

a plurality of assemblies of antenna elements arranged on the substrate (11), each assembly corresponding to a direction of the antenna;

wherein the antenna further comprises a dielectric superstrate (12), having a permittivity ($\in_2$) greater than the permittivity ($\in_1$) of the substrate (11), arranged on the assemblies of antenna elements, and in that the assemblies are interleaved one under the other so as to form a column of antenna elements in a periodic manner, the period being equal to the number of direction of the antenna.

2. Antenna according to claim 1, wherein the antenna elements of a single assembly are spaced apart by a distance less than one wavelength λ, the wavelength λ corresponding in the monofrequency case to the frequency at which the antenna has to operate and in the multifrequency case to the central frequency defined by $(f_{max}-f_{min}/2$ where $f_{max}$ is the maximum frequency at which the antenna has to operate and $f_{min}$ is the minimum frequency at which the antenna has to operate.

3. Antenna according to claim 1 or claim 2, wherein the antenna elements belonging to different assemblies are spaced apart by a distance less than λ/n, where λ corresponds to:

in the monofrequency case, the frequency at which the antenna has to operate;

in the multifrequencies case, the central frequency defined by $(f_{max}-f_{min})/2$ where $f_{max}$ is the maximum frequency at which the antenna has to operate and $f_{min}$ is the minimum frequency at which the antenna has to operate; and where n is the number of different assemblies ($E_i$).

4. Antenna according to claim 1, comprising for each direction of the antenna an identical number of assemblies of antenna elements.

5. Antenna according to claim 1, wherein the assemblies corresponding to a single antenna direction are connected in series or in arborescence.

6. Antenna according to claim 1, wherein each assembly comprises an identical number of antenna elements.

7. Antenna according to claim 1, wherein the antenna elements are square, equilateral triangle shaped or ellipsoidal shaped patches.

8. Antenna according to claim 1, wherein each side of each antenna element is of dimension equal to $$\frac{\lambda_0}{4\sqrt{\varepsilon_1 + \delta\varepsilon_2}}$$

where $\in_1$ is the permittivity of the substrate and $\in_2$ is the permittivity of the superstrate, λ is the wavelength corresponding to the frequency associated with the antenna element, the value $\sigma$ is approximately equal to: $\sigma=h_1/(h_1+d)$.

9. Antenna according to claim 1, wherein the antenna elements are patches with double orthogonal polarisation having two independent accesses making it possible to achieve diversity of polarisation.

10. Cellular communication network comprising an antenna according to claim 1.

* * * * *

UNITED STATES PATENT AND TRADEMARK OFFICE

CERTIFICATE OF CORRECTION

PATENT NO. : 8,704,727 B2
APPLICATION NO. : 13/319992
DATED : April 22, 2014
INVENTOR(S) : Eduardo Motta Cruz et al.

It is certified that error appears in the above-identified patent and that said Letters Patent is hereby corrected as shown below:

On the Title Page, in Item (75), under Inventors, line 5, please delete "Lyons" and insert --Lyon--.

Signed and Sealed this
Eighteenth Day of November, 2014

Michelle K. Lee

Michelle K. Lee
*Deputy Director of the United States Patent and Trademark Office*